US005295452A

United States Patent [19]

Frye et al.

[11] Patent Number: 5,295,452

[45] Date of Patent: Mar. 22, 1994

[54] ADJUSTABLE STAND FOR SEWING MACHINES

[75] Inventors: Ricky J. Frye, Miamisburg; Robert N. Landis, New Lebanon, both of Ohio

[73] Assignee: MIM Industries, Inc., Miamisburg, Ohio

[21] Appl. No.: 763,286

[22] Filed: Sep. 20, 1991

Related U.S. Application Data

[63] Continuation-in-part of Ser. No. 694,931, May 2, 1991, Pat. No. 5,174,227.

[51] Int. Cl.[5] ..... D05B 75/00; A47B 29/00

[52] U.S. Cl. ..... 112/217.1; 112/260; 108/7

[58] Field of Search ..... 112/2, 67, 121.12, 121.29, 112/217.1-217.4, 258, 260; 108/1, 5, 6, 7, 10, 20, 28, 102, 144, 145, 150, 2; D6/396, 422; D15/66, 74

[56] References Cited

U.S. PATENT DOCUMENTS

| | | | |
|---|---|---|---|
| 390,199 | 10/1888 | Blackmore | 108/5 |
| 953,719 | 4/1910 | Skripec | 108/7 |
| 1,916,537 | 7/1933 | Smith | 108/8 |
| 2,683,067 | 7/1954 | Hartman | 108/7 |
| 2,795,473 | 6/1957 | Smith | 108/28 X |
| 2,899,249 | 8/1959 | Kishibay | 112/217.1 |
| 3,246,612 | 4/1966 | Ballas | 108/6 |
| 3,327,662 | 6/1967 | Abate et al. | 112/217.3 |
| 3,606,450 | 9/1971 | Sedgwick | 108/6 |
| 3,690,608 | 9/1972 | Poizner | 108/7 X |
| 4,077,333 | 3/1978 | Ballas | 108/6 |
| 4,290,657 | 9/1981 | Haas | 112/217.1 X |
| 4,383,486 | 5/1983 | Reineman et al. | 108/6 X |
| 4,440,096 | 4/1984 | Rice et al. | 108/5 X |
| 4,566,732 | 1/1986 | Ostergaard, II et al. | 108/8 X |

FOREIGN PATENT DOCUMENTS

| | | | |
|---|---|---|---|
| 0269084 | 8/1966 | Australia | 112/217.1 |
| 1142082 | 5/1969 | France | 108/1 |
| 2263328 | 10/1975 | France | 112/217.1 |
| 0207694 | 10/1985 | Japan | 112/121.12 |
| 1-317478 | 12/1989 | Japan | 112/217.1 |
| 8801157 | 12/1989 | Netherlands | 108/5 |
| 0260385 | 8/1949 | Switzerland | 108/7 |
| 0619392 | 3/1949 | United Kingdom | 108/7 |
| 2197584 | 5/1988 | United Kingdom | 108/7 |

*Primary Examiner*—Clifford D. Crowder
*Assistant Examiner*—Ismael Izaguirre
*Attorney, Agent, or Firm*—Joseph G. Nauman

[57] ABSTRACT

A stand for sewing machines with an open base design is readily accessible to users in special seating such as wheel chairs, and adaptable to accessory equipment related to the handling of materials. A vertically adjustable pedestal extends upward from one side of the base. On the pedestal, extending out over the base, is a platform which receives and holds a variety of sewing machines. Adjustable attaching mechanisms on the platform connect to the bases of different sewing machines, to support them securely and to present them at various orientations above the open base of the stand. Attaching mechanisms are provided for a variety of table configurations, each adapted to the configuration of the sewing machine mounted in the stand for quick interchange of tables onto the platform. The platform is attached to the top of the pedestal by a rotary joint of substantial proportions which provides for rotation of the entire platform about an axis extending horizontally, side-to-side, over the open base. The entire stand is mounted on feet and/or rollers which permit rotational motion of the entire stand and the machine thereon about vertically extending axes.

5 Claims, 5 Drawing Sheets

ADJUSTABLE STAND FOR SEWING MACHINES

CROSS-REFERENCE TO RELATED APPLICATION

This application is a continuation-in-part of U.S. patent application Ser. No. 07/694,931 filed May 21, 1991 now U.S. Pat. No. 5,174,227 and assigned to the same assignee as this application.

BACKGROUND OF THE INVENTION

The invention relates to adjustable stands, and particularly so-called ergonomic stands, for supporting industrial sewing machines and the like. The purpose of the stand is to optimize user-machine interface and comfort, and also to provide a stand which can support different makes of sewing machines and auxiliary devices.

DESCRIPTION OF RELATED ART

Due to the large variety of jobs required of industrial (or commercial) sewing machines, it is often necessary to arrange special devices to hold, to guide, to feed and/or to remove, various sizes and shapes of cloth and similar pieces being joined by the mechanism of the sewing head of the machine. In the past, each adaptation has been a custom arrangement, often haphazardly erected by the user of the equipment, and little planning has been expended on the provision of adaptable stands, etc. by the suppliers of the equipment.

In addition, as consciousness regarding employment of handicapped persons has expanded, there has been a realization that, with some forethought, the operation of industrial sewing equipment is a job market available to persons with varying handicaps, and who may be wheel-chair bound or similarly partially incapacitated. This availability can readily be enhanced by design of adaptable, ergonomic stands and/or supports for the sewing equipment. Thus, a need has been observed for a basic adjustable sewing machine stand which can accomplish three-dimensional adjustment of the sewing head to present it conveniently to such workers, while also adapting to a variety of specific job-related needs.

SUMMARY OF THE INVENTION

The present invention provides a stand with an open base design, readily accessible to users in special seating such as wheel chairs, and likewise accessible to accessory equipment related to the handling of materials. A vertically adjustable pedestal extends upward from one side of the base, and at the top of the pedestal, extending out over the base, is a framework or platform which can receive and hold a variety of sewing machines. This platform includes adjustable attaching mechanisms for connecting to the bases of different sewing machines, so as to support them securely and to present them at a desired orientation above the open base of the stand.

There are also attaching mechanisms for a variety of table configurations, each of which may be adapted to the configuration of the sewing machine mounted in the stand. This allows quick interchange of tables onto the platform when a certain table design is needed to facilitate a specified task to be performed by the machine and operator.

The platform is attached to the top of the pedestal by a rotary joint of substantial proportions which provides for rotation of the entire platform about an axis extending horizontally, side-to-side, over the open base. The entire stand is mounted on feet and/or rollers which permit rotational motion of the entire stand and the machine thereon about vertically extending axes.

The principal object of the invention, therefore, is to provide a unique adjustable stand for a sewing machine; to provide such a stand which will accept a variety of commercial type sewing machines; to provide such a stand having an open base construction permitting placement of special operator seating and auxiliary equipment into convenient and comfortable proximity to the sewing head of the supported machine; to provide in such a stand a vertical adjustment for a framework-like platform onto which the various styles of machine can be latched; to provide mechanisms for quick mounting and interchange of special tables on the platform, at least partially surrounding the machine base; to provide a rotatable supporting joint between the stand and platform allowing tilting of the supported machine and table about a horizontal axis extending over the base of the stand; to provide support for the stand itself which allows adjustment of the machine about vertical axes.

Other objects and advantages of the invention will be apparent from the following description, the accompanying drawings and the appended claims.

DESCRIPTION OF THE PREFERRED EMBODIMENT

Figure 1:
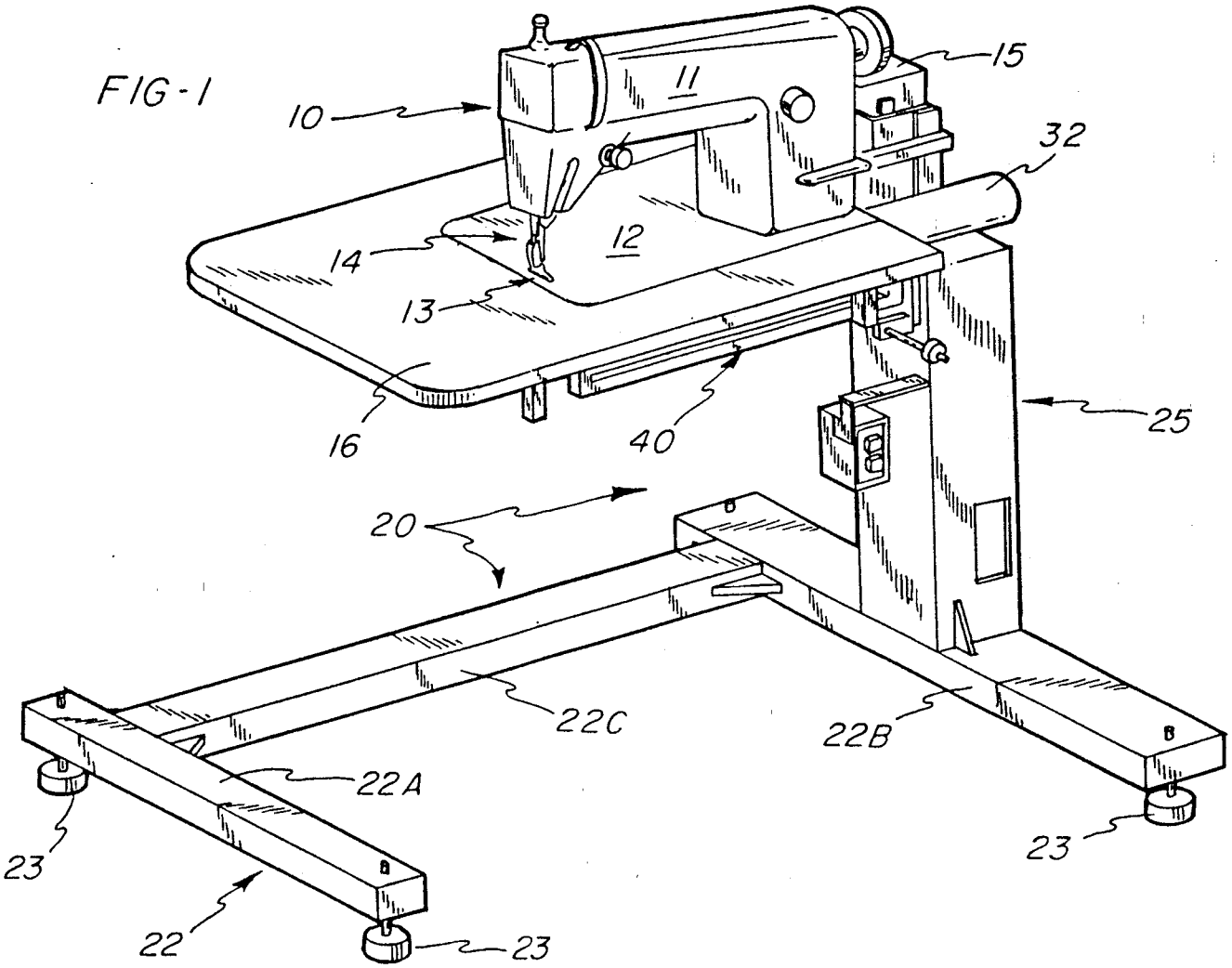
FIG. 1 is a perspective over-all view of the adjustable sewing machine stand provided by the invention, with a typical sewing machine and one form of work table mounted thereon.

Referring to the drawings, particularly to FIG. 1, there is illustrated in somewhat schematic manner a sewing machine 10 including a sewing head 11 and a base 12. The base includes the usual presser foot 13 and reciprocating power driven needle 14, and a foot plate (within the base 12) which includes the usual bobbin and reciprocably moving feed dog (not shown). The present invention is adaptable to a variety of such machines, it being understood that each includes basically the aforementioned elements in unique design and dimensional arrangement. A motor 15 is mounted in a fixed relation to the sewing head, as later described, and provides rotary power for the sewing head and for the parts within the foot plate, in conventional fashion. A table 16 surrounds base 12. The table 16 has an internal opening which is contoured to surround base 12 of machine 10, and an outer configuration which may be variable, and is adapted to particular tasks of the machine. Table 16 is thus demonstrative of a variety of table sizes and shapes which can be mounted interchangeably about the base of the machine as later described in more detail.

The entire machine is mounted to a stand 20, and including a generally U-shaped base 22 having a shorter leg 22A, a longer leg 22B, and a rearward located cross member 22C connecting the two legs. Adjacent the ends of the legs, adjustable feet 23 are provided; these feet may also be in the form of rollers or casters (not shown). A vertically extending post 25 extends upward from the front to back center of the longer leg 22B.

Figure 2:
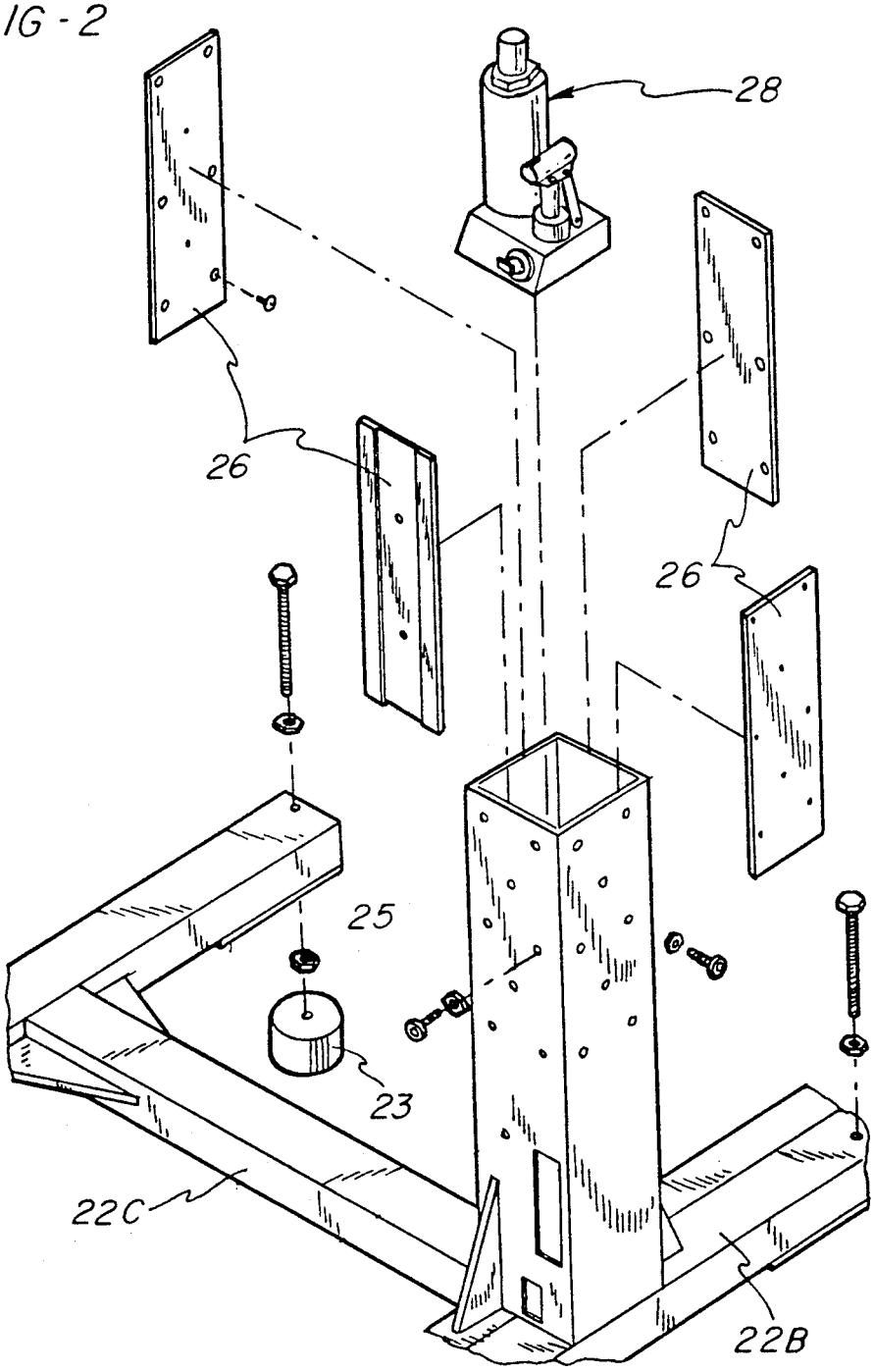
FIG. 2 is an exploded view of the base parts of the pedestal or tower of the stand.

As seen in FIG. 2, post 25 is hollow, of generally square cross-section, and is fitted with four gibs or guide plates 26, at least some of which may be adjustable with respect to their associated post wall, so as to maintain a tight sliding bearing assembly within post 25. A hydraulic jack 28 is located within the bottom of post 25, and may be actuated by inserting an appropriate rod through access hole 29.

A vertically adjustable internal post 30 (see FIG. 3) is received in telescopic fashion within post 25, and can be raised by jack 28. On top of post 30 is a cross-mounted cylindrical bearing support or sleeve 32, which preferably includes a clamp 32A for adjusting the tightness of the bearing sleeve. A plate 33 extends about and downward from one end of sleeve 32, and provides a mounting for a worm gear 34A which has attached to it a rotating handle 34B.

Figure 3:
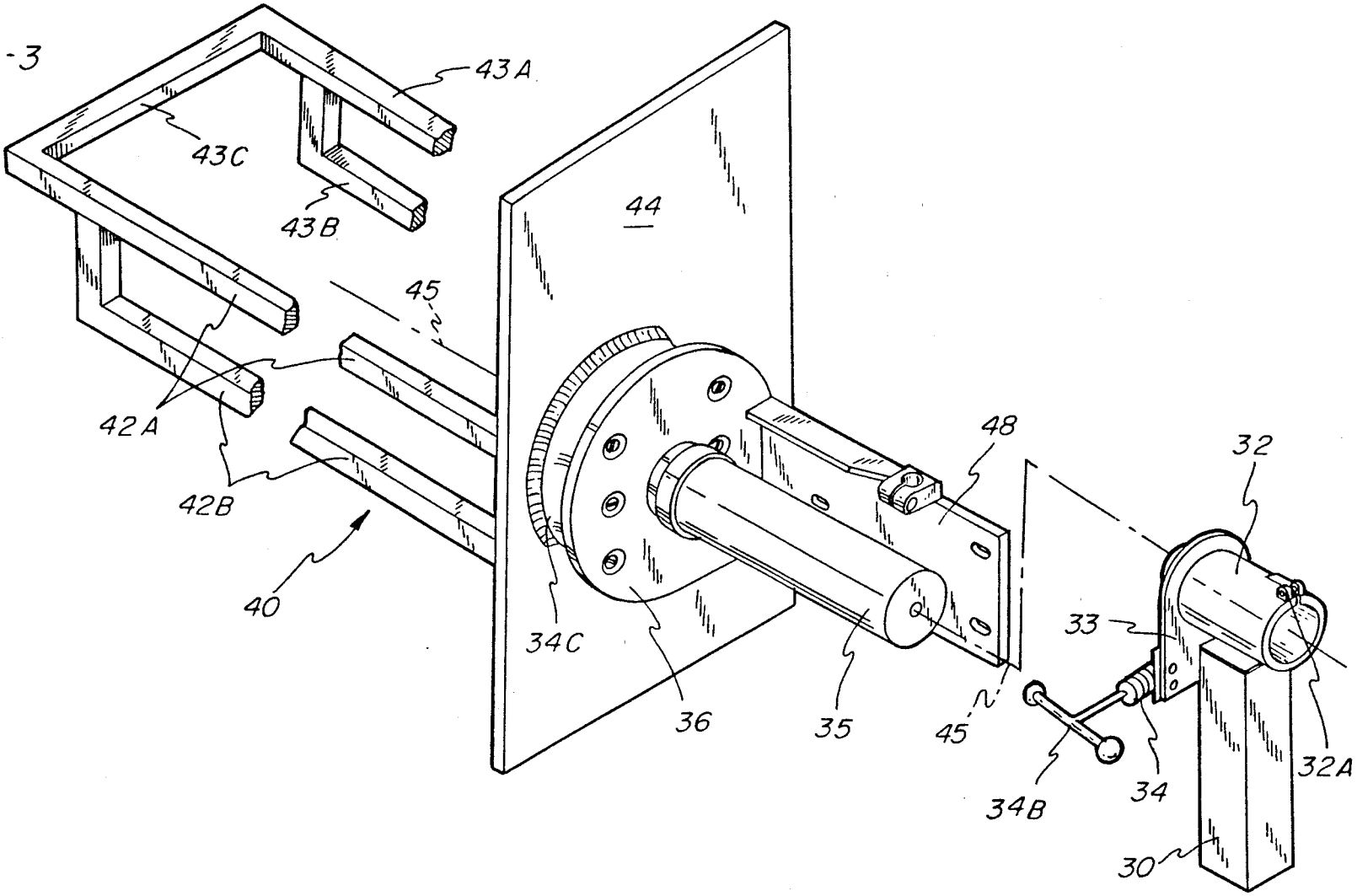
FIG. 3 is a perspective view of the pedestal supported platform and its rotatable mount, with portions of the mount shown separated from each other.

Support sleeve 32 receives and holds a horizontally extending shaft 35 which is fixed at one end to a plate 36. That plate forms one end of a machine and table supporting platform 40. This platform is skeletal in nature, formed for example of square tubing or bar stock, and comprises upper and lower front rails 42A, 42B, similar rear rails 43A, 43B, and a connecting end rail 43C. The rails are all secured, as by welding, to each other and to an end plate 44, extending outward perpendicular to its surface, with the centerline of sleeve 32 being approximately coincident with the center of the platform between the upper rails; this centerline is indicated in FIG. 3 by the dot-dash line 45.

The worm wheel 34C is bolted (or otherwise attached) to plates 36 and 44 on the side opposite shaft 35, with its center (axis of rotation) located on centerline 45. Therefore, rotation of handle 34B causes worm wheel 34C to rotate and adjust the angular position of the entire platform 40 about a horizontal axis, e.g centerline 45. A bracket 48 extends from plate 36, spaced from and parallel to shaft 35, and provides a convenient mounting for the motor 15 (FIG. 1) which drives the sewing machine. This is a conventional motor having a belt drive to the sewing head, and preferably having a digital controller (not shown) such as is often used in such machines. Thus, the motor 15 and its mounting rotate with the sewing machine and supporting platform 40, and belt tension or other adjustments are not disturbed by such rotation.

Figure 5:
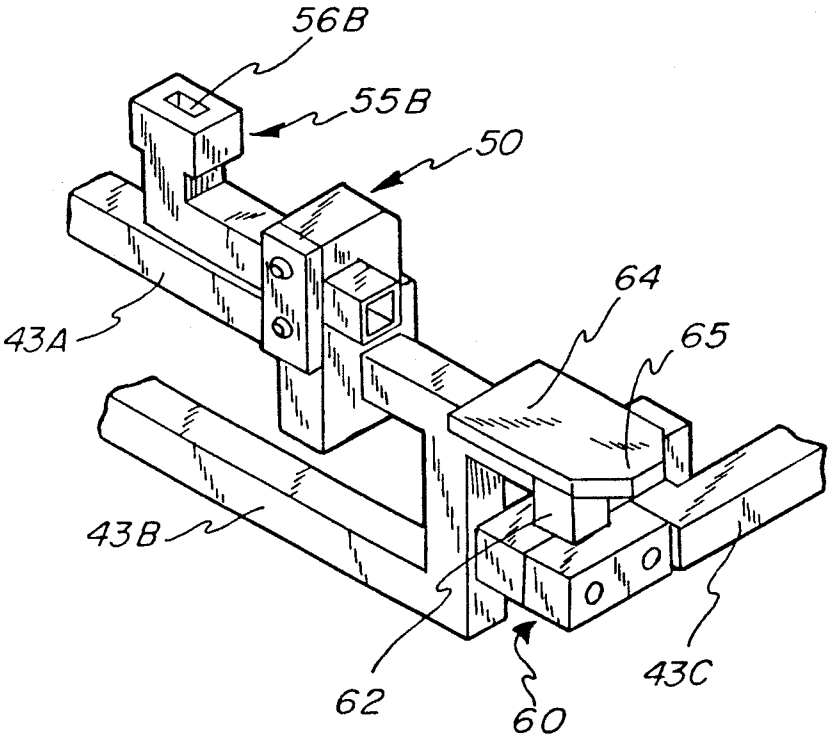
FIGS. 4 and 5 are enlarged perspective views of details of the adjustable platform mechanisms which attach to the bases of different sewing machine heads, and to different forms of tables.
Figure 4:
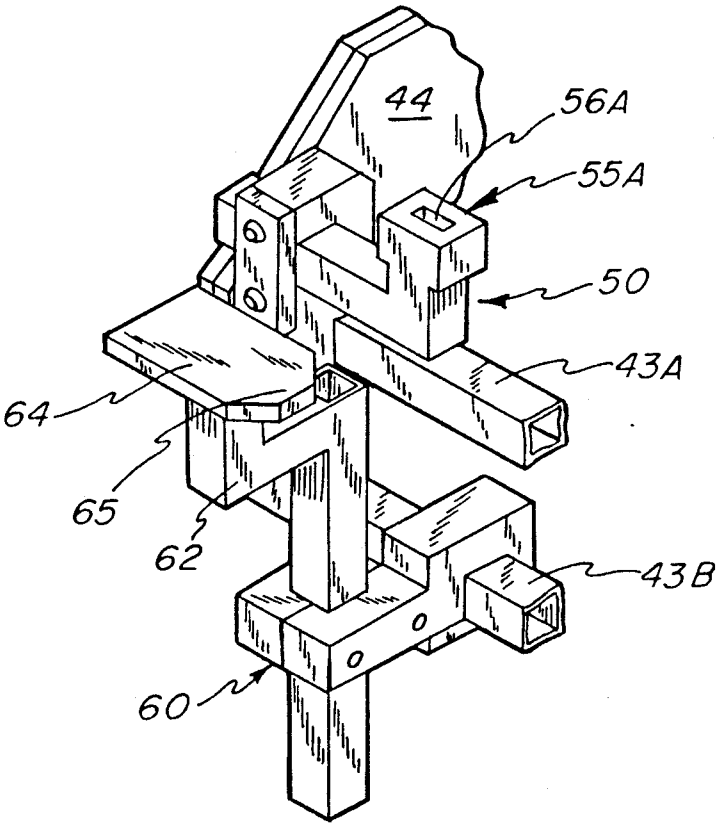

FIGS. 4 and 5 show details of adjustable mounting mechanisms 50 which are fitted to the platform rails, and can slide therealong. Sewing heads typically have two spaced apart fittings which form a hinge mounting aligned along the rear of the machine base 12. The machine support receptacles incorporated into mechanisms 50 include receptacles 55A, 55B to receive these fittings, and include slots 56A, 56B into which the fitting can be engaged. The mechanisms 50 and receptacles are supported on the rear upper rails 43A and can be moved along those rails, and clamped at a selected position, to accommodate the hinge fitting spacings of different machines. The front of the machine base 12 is supported by similar mechanisms carried on front upper rail 42A and providing rest pads in place of the receptacles. Thus, the rear of a machine base 12 is effectively hinged to the rearward platform rail, and the front of the machine base rests on pads which support the base on the front platform rail.

Various forms of table 16, as mentioned, may be used. The mechanisms 60 provide the basis for adjustable table supports, and as seen in FIG. 5, are slidably mounted on the lower rails 43B (corresponding mechanisms, not shown, are provided on the front rails), and on the extension of the upper rails as shown in FIG. 5. The mechanisms 60 include vertically adjustable extensions 62 having support shoes 64 at their tops, with angled entry ends 65. Shoes 64 are adapted to enter into slotted receptors or pockets (not shown) on the table bottoms. Only the rear shoes on the platform are illustrated, it being understood that the front shoes are of complementary construction.

Thus, a desired table can be mounted simply by adjusting the location of mechanisms 60 on platform 40 and then securing the table to the shoes by simply sliding the table receptors over the four shoes. This facilitates quick interchange of tables. Such interchange may be as a result of particular job requirements, or a need to adapt a particular machine to the specialized needs of a handicapped operator.

Figure 6:
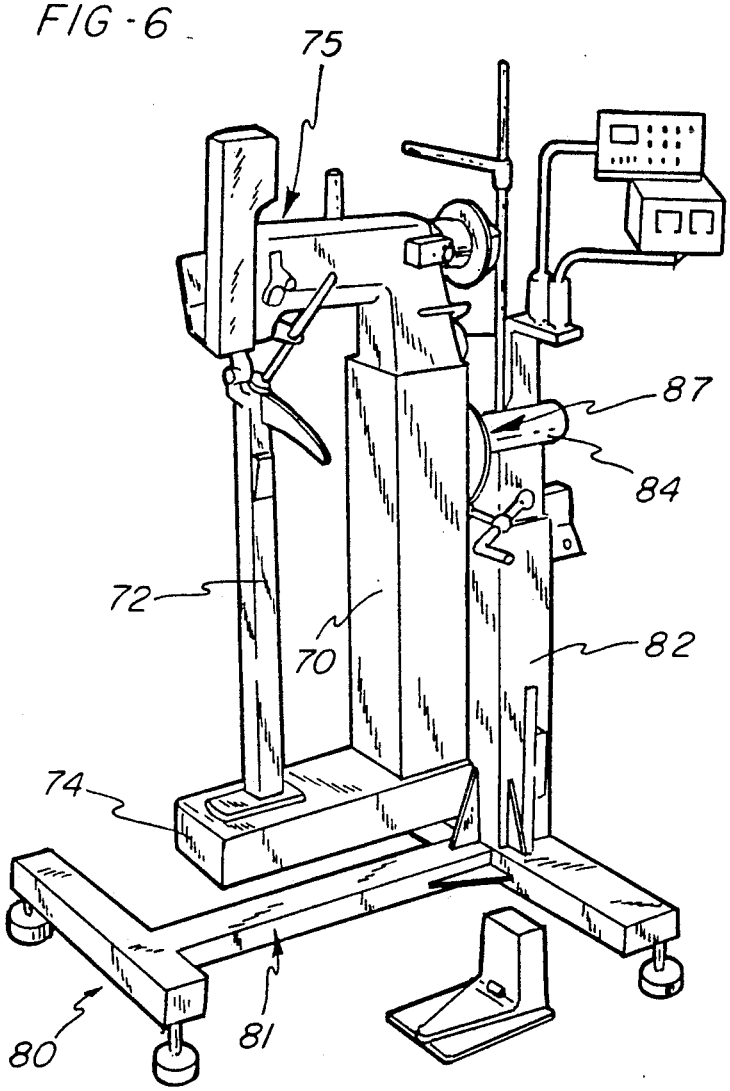
FIG. 6 is a perspective view of an extended post sewing machine and its supporting pedestal and stand, which comprises another form of device to which the invention can be applied.

Referring to FIG. 6, a post-type sewing machine is shown having a main vertical extension 70 and a vertically elongated stitching post 72 supported on the machine base 74, and in turn supporting and forming a mounting for a conventional sewing head 75. A motor 77 provides rotary power for the sewing head and (through extended shafting not shown) for the parts within the post 72, in conventional fashion. The entire machine is mounted to a stand indicated generally at 80 which includes a generally open H-shaped base 81 and a vertically adjustable upward extending pedestal 82 on top of which is a cross-mounted bearing support or sleeve 84. This support receives a horizontally extending shaft which is fixed at one end to the main vertical extension 70, holding the base 74 of the machine suspended slightly above the stand base 80. A worm/worm gear mechanism 87 is mounted between pedestal 82 and sleeve 84, to control rotational adjustment of the machine over the stand.

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. An adjustable stand for sewing machines, comprising an open base accessible to users and to accessory equipment related to the handling of materials for use with the sewing machine, said base having a front, a rear, and opposites sides, and including spaced apart horizontally extending side legs and a cross member of substantially greater length than said side legs and connecting said side legs at said rear of said base, a vertically adjustable pedestal extending upward from one side of said base, a rotary support sleeve fixed to the top of said pedestal, a support shaft rotatably received in said sleeve, a plate extending transversely to and fixed to said support shaft, a platform extending from said plate over said base for holding a variety of sewing machines over said base and providing adjustment of an orientation of the machine with respect to said base about a horizontally extending axis extending out above said base, means for rotating said support shaft to adjust the orientation of said platform about a longitudinal axis extending over said base, said platform including a framework extending outward from said plate above and parallel to said base, mounting mechanisms fitted to said platform and slidable longitudinally thereof for receiving fittings found at the base of different types of sewing machines, to adapt and retain each type selectively to said platform, and a bracket attached to said support shaft and extending in spaced relation parallel to said sleeve, said bracket providing a motor mount for a driving motor connected to the sewing machine, whereby a rotating motion of the support shaft does not affect a motor to sewing machine drive connection.

2. The stand as defined in claim 1, said legs including feet having means for providing rotational motion of the entire stand and a machine thereon about vertically extending axes.

3. The stand as defined in claim 1, further including a worm gear attached to said pedestal in fixed relation to said sleeve, a worm wheel attached to said support shaft and meshing with said worm gear, whereby rotation of said worm gear controls the tilt angle of said platform and a sewing machine attached thereto.

4. An adjustable stand for sewing machines, comprising an open base accessible to users and to accessory equipment related to the handling of materials for use with the sewing machine, said base having a front, a rear, and opposites sides, and including spaced apart horizontally extending side legs and a cross member of substantially greater length than said side legs and connecting said side legs at said rear of said base, vertically adjustable pedestal extending upward from one side of said base, a rotary support sleeve fixed to the top of said pedestal, a support shaft rotatably received in said sleeve, a plate extending transversely to and fixed to said support shaft, a platform extending from said plate over said base for holding a variety of sewing machines over said base and providing adjustment to an orientation of the machine with respect to said base about a horizontally extending axis extending out above said base, means for rotating said support shaft to adjust the orientation of said platform about a longitudinal axis extending over said base, said platform including a framework extending outward from said plate above and parallel to said base, mounting mechanisms fitted to said platform and slidable longitudinally thereof for receiving fittings found at the base of different types of sewing machines, to adapt and retain each type selectively to said platform, and said mounting mechanisms having receptacles for engaging with the fittings on a sewing machine to provide a hinge-like connection between a selected machine and said platform.

5. An adjustable stand for sewing machines, having an open base accessible to users and to accessory equipment related to the handling of materials for use with the sewing machine, said base having spaced apart horizontally extending side legs and a cross member connecting said side legs, a vertically adjustable pedestal extending upward from one side of said base, a platform having means for receiving and retaining a variety of sewing machines thereon extending out over said base from the top of the pedestal, said platform including a framework including front and back rails extending parallel to each other and to said sleeve and support shaft, and mounting mechanisms on said rails for receiving fittings found at the base of different types of sewing machines, to adapt and retain each type selectively to said platform, said mounting mechanisms having receptacles for engaging with the fittings on the sewing machine to provide a hinge-like connection between a selected machine and said platform.

* * * * *